US005348059A

United States Patent [19]

Carroll

[11] Patent Number: 5,348,059

[45] Date of Patent: Sep. 20, 1994

[54] MULTI FUNCTION REFILL ADAPTOR FOR GAS OPERATED AIRGUNS

[75] Inventor: Kent L. Carroll, Bolingbrook, Ill.

[73] Assignee: Air America, Glenview, Ill.

[21] Appl. No.: 117,527

[22] Filed: Sep. 7, 1993

[51] Int. Cl.[5] ..... F17C 5/00; F41B 11/00

[52] U.S. Cl. ..... 141/21; 141/18; 141/104; 141/349; 124/70; 124/71

[58] Field of Search ..... 285/12; 141/2-4, 141/18, 21, 104, 105, 347-349, DIG. 2; 124/70, 71, 73

[56] References Cited

U.S. PATENT DOCUMENTS 2,501,611 3/1950 Nicholson ..... 141/3
5,000,155 3/1991 Gallagher ..... 124/71
5,063,960 11/1991 Kremer ..... 141/18 X
5,088,436 2/1992 Stritmatter ..... 141/18 X
5,113,905 5/1992 Pruitt et al. ..... 137/571
5,257,614 11/1993 Sullivan ..... 124/73

*Primary Examiner*—J. Casimer Jacyna
*Attorney, Agent, or Firm*—Robert J. Black

[57] ABSTRACT

The invention is an attachment for airguns and/or similar devices powered by compressed gas. The unit is multi functional in that it facilitates rapid refilling of a connected gas supply vessel from a bulk supply source, without the necessity of removing the supply vessel from the airgun. The adaptor also provides the basic benefits of a simple expansion chamber, effectively providing compensation for periodic introduction of any liquid gas propellant from the gas supply vessel caused by handling or orientation of the airgun and/or aerosol supercharging.

14 Claims, 1 Drawing Sheet

MULTI FUNCTION REFILL ADAPTOR FOR GAS OPERATED AIRGUNS

BACKGROUND OF THE INVENTION

1. FIELD OF THE INVENTION

The present invention relates to airguns and/or similar devices powered by compressed gas and more particularly by an adaptor that facilitates the rapid refilling of the gas containing supply vessel without the necessity for removing the supply vessel from the airgun.

2. BACKGROUND ART

A search of the background art directed to the subject matter of the present invention conducted in the U.S. Patent and Trademark Office disclosed the following U. S. Letters Patent:

U.S. Pat. No. 5,000,155 which issued on Mar. 19, 1991 to Denis R. Gallagher. This patent covered a connector to an external air source for a gas operated gun, which includes a cartridge piercing receiving assembly adapted to engage a pressurized air source and connected externally to a gas operated gun.

Also discovered was U.S. Pat. No. 5,113,905 which issued on May 19, 1992 to John E. Pruitt et al. This patent teaches a carbon dioxide fill manifold for storing liquid and gaseous carbon dioxide by including means for dispensing the gaseous carbon dioxide, which provides a degree of protection against loss of carbon dioxide during a refilling procedure.

A thorough review of the above-identified patents indicates that none teach, disclose or claim the novel combination of elements and function found in the improved airgun compressed gas refill adaptor.

The use of carbon dioxide gas as a propellant in air guns is a well known and accepted practice. Such carbon dioxide gas is generally stored in a liquid state. Most airguns perform best when the propellant is used exclusively in a gaseous state. The actual product delivered from high pressure carbon dioxide (CO2) storage vessels is a variable mixture of liquid and gaseous CO2. The presence of liquid CO2 within the storage vessel sometimes creates a problem. In the past the usual procedure for refilling the supply vessel or CO2 tank connected to an airgun has required removal of the supply vessel from the airgun.

As can be anticipated there are multiple problems associated with removal of the supply vessel. It may be readily anticipated that this action exposes the user to escaping high pressure gas with the resultant related safety hazards. Secondly, repeated removal and reinstallation of the supply vessels cause wear on both the mechanical attachment and on the gas seals incorporated therein. Finally, the requirement to remove the supply vessel from the airgun makes the operation needlessly time consuming.

SUMMARY OF THE INVENTION

The multi function refill adaptor for gas operated airguns as taught by the present invention consists of an inner support element or strut that threads into the standard existing Conference of Gas Association (C.G.A.) fitting on most standard gas operated airguns. Included within the support strut, which effectively has a hollow tubelike configuration, is a reverse flow check valve and a gas delivery port. After the inner support unit has been affixed to the fitting on the airgun, an upper outer sleeve is slid over it to create an upper enclosure followed by a lower sleeve over the lower portion. Between the upper and lower portions and the inner strut, gas tight seals are achieved by means of multiple "0" ring sites included on the inner strut.

The multi function refill adaptor of the present invention is designed to permit the rapid refilling of an associated supply vessel, associated with the airgun, at the same time providing the benefits of an expansion chamber to effectively deal with the periodic introduction of any liquid propellant caused by the handling or orientation of the airgun and/or that phenomenon referred to as "aerosol supercharging". It is this combination of features which allows the user to utilize other compressed gases as well as CO2 to power the airgun from the gas supply unit attached thereto.

In the initial or usual mode of operation, the lower outer sleeve actively blocks any access or egress to the center strut except by means of an opening included in the upper sleeve.

When in normal use, initially between a supply source of CO2 and an associated airgun, propellant gas from the supply vessel enters the adaptor of the present invention at a midpoint on the upper sleeve body, through a small diameter orifice in the strut. The orifice is sized to create a "spray nozzle" effect as the propellant enters the unit. Thus when CO2 is being utilized, a liquid to gas transition is enhanced by pressure variations produced by the gas stream passing from the small orifice into a large volume chamber contained within the strut. Additionally, that internal configuration of the strut creates a sump which allows any liquid CO2 that enters the unit to find a point to drop to, that is out of the high speed gas flow caused by subsequent operation of the airgun. This arrangement minimizes the splash and aeration that would otherwise contribute to the problem of aerosol supercharging. It also facilitates the changing from liquid to gaseous state in due course.

The lower portion of the multi function refill adaptor includes, through a lower sleeve slide, a plug type fitting which mates with a matching female collar attached to the bulk gas supply vessel. As noted before, "0" ring sites on the outside diameter of the center strut accomplish the sealing between the center strut and lower slide, sometimes referred to as a "female fill collar". CO2, or similar gas, then flows through the center strut past the included lower strut check valve, from there through the upper orifice in the strut side wall and through the upper sleeve orifice to the associated supply vessel connected thereto. After the unit is fully charged and the source of pressurized gas is removed from the lower sleeve fitting, the valve restores, sealing effectively both the adaptor unit of the present invention and the gas supply vessel connected thereto. When not in use, the lower mating portion of the center strut and its included "0" rings therein are protected by the normal lower slide unit.

DETAILED DESCRIPTION OF THE PREFERRED EMBODIMENT

Figure 1:
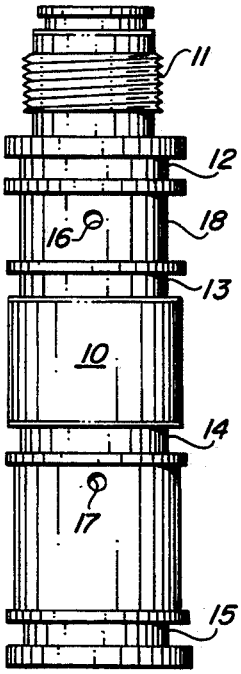
FIG. 1 is a side view of a center strut or element for use in a refill adaptor for airguns in accordance with the present invention.
Figure 2:
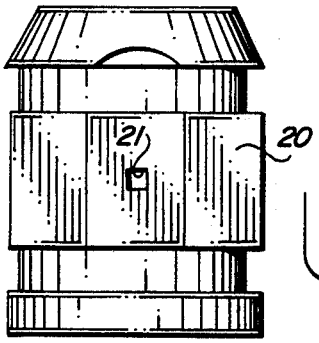
FIG. 2 is a side view of an upper sleeve element for positioning over the center strut of the refill adaptor in accordance with the present invention.

Referring now to FIGS. 1, 2, 3, 4 and 5 of the accompanying drawings of the application, the multi function refill adaptor of the present invention consists of five basic parts. The center element, or strut 10, an upper outer sleeve 20, a lower outer sleeve 30, a check valve assembly consisting of stationary unit 40 and multiple seal unit 41, and an alternate lower sleeve or female refill collar 50.

The center strut unit 10 is essentially a hollow cylindrical device having at its top end a threaded section 11 adapted to be threaded into a standard C.G.A. fitting found on all applicable airguns. An airgun or other device lacking the appropriate threading to receive the threads could be modified to meet the necessary requirements, or in the alternative, an adaptor could be utilized. Such changes do not affect the basic design of the present invention and accordingly do not form a portion of the invention.

Figure 6:
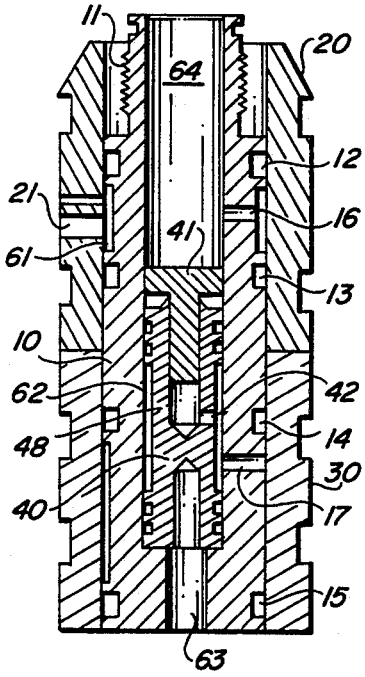
FIG. 6 is a sectional view of a refill adaptor for compressed airguns in accordance with the present invention, including a lower sleeve element as used during normal operation of the airgun, functioning as an expansion chamber.

Located in several positions around the strut 10 are a number of "O" ring receiving sections 12, 13, 14 and 15. "0" rings positioned in 12 and 13 provide an effective seal between the center strut and the inside portions of upper sleeve assembly 20. "O" ring locations 14 and 15, equipped with "O" rings, provide seals between the lower sleeve 30 or female adaptor 50. Further included in strut 10 is a reduced diameter area 18 which in combination with the interior of upper sleeve 20 form a CO2 sump 61, as seen in FIG. 6. Also included in center strut 10 are upper orifice 16, providing a connection between an inner portion of strut 10 and an associated supply vessel. A lower orifice 17 provides a connection to a fitting and refill adaptor 50, which facilitates the flow of incoming propellant gas from an external supply source through to the inner portion of check valve body 40, which is located within the center portion of strut 10 as may be readily seen in FIGS. 6 or 7.

The upper sleeve 20 around center strut 10 (at its upper end) provides by means of an orifice contained therein connection to the airgun normal gas supply vessel. As noted previously, a tight seal between strut 10 and upper sleeve 20 exists by virtue of "O" rings positioned on the strut at locations 12 and 13 as seen in FIG. 1.

Element 30 is a lower sleeve unit consisting primarily of a hollow cylinder which in function slides over the lower portion of strut 10 providing gas tight seals by virtue of "O" rings located at locations 14 and 15 by also providing a seal to orifice 17 in normal operation.

Figure 4:
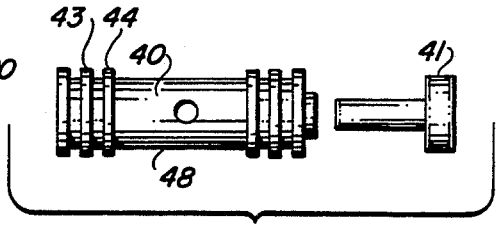
FIG. 4 is a side view of a reverse flow check valve for use within the refill adaptor in accordance with the present invention.
Figure 3:
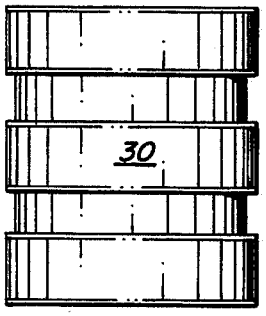
FIG. 3 is a side view of a lower sleeve element for use with the center strut of the present invention.
Figure 7:
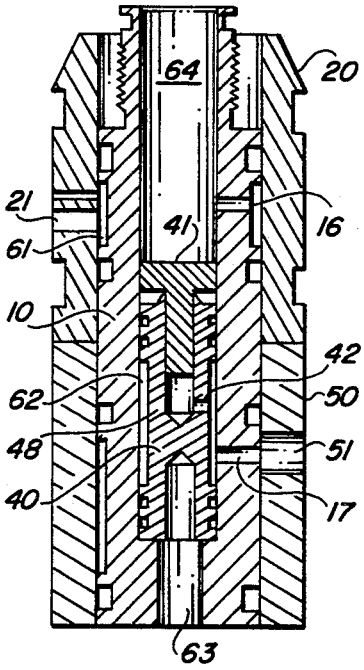
FIG. 7 is a sectional view of a multi function refill adaptor in accordance with the present invention and a refill lower sleeve for use in filling an associated supply vessel through the refill adaptor of the present invention.

FIG. 4 is a side view of a check valve assembly consisting of a hollow tube 40 having an opening therein with a movable valve section 41 normally positioned within the end of cylinder 40 as may be readily seen in FIGS. 6 and 7. "O" rings located at locations 43, 44, 45 and 46 provide an effective seal between the check valve and the interior portion of strut 10. This can be seen in FIGS. 6 and 7.

Figure 5:
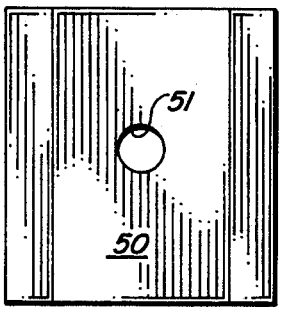
FIG. 5 is a side view of a refill sleeve for use with the refill adaptor in accordance with the present invention.

FIG. 5 discloses an alternate lower slide or female refill collar 50. This unit is also a hollow cylinder containing therein an orifice 51. As may be seen when positioned over the lower portion of strut 10, orifice 51 is an external fitting or a "banjo" type fitting that allows complete control of the orifice size, facilitating connection to a bulk source of liquid CO2. When positioned properly, the lower sleeve 50 includes proper positioning of orifice 51 through to orifice 17 which extends to a lower CO2 sump 62 during any refilling operation.

Referring now to FIG. 6, the threaded portion 11 of strut 10 is threaded into a standard C.G.A. fitting, usually found on all applicable airguns or similar devices. As noted previously, airguns or devices lacking the standard receiver adapted for the mating threads on the center strut need only be modified to match the application requirements by means of an adaptor or by virtue of initial design. Once the center strut 10 is located, upper sleeve 20 is positioned over the strut in the location shown in FIG. 6. In operation, propellant gas from the normally connected supply vessel enters adaptor unit through a calibrated orifice 21. The external fitting connected to the multi function refill adaptor of the present invention is a "banjo" type fitting which allows complete control of the orifice size. Independent of the physical attachment requirements, gas passing through orifice 21 into a larger internal volume, consisting basically of sump 61, which was formed between the outer walls of strut 10 location 18 and the inner walls of upper sleeve 20 creates a pressure reduction point, thus the enhancing tendency of any liquid CO2 present to convert to a gaseous form.

Once the gas stream has entered the lower portion of the unit, any liquid CO2 present will migrate to sump area 61 as a result of gravity. Any liquid collecting in sump 61 will eventually convert to a gaseous state in the normal course of operation. The gas stream then passes through transfer orifice 16 into central cavity 64 of center strut 10. Central cavity is configured to also create an internal sump intended to help the unit deal with any flooding by liquid CO2. Under normal operation, no liquid would be present in this sump. Should other gases than CO2 be used, such gases are normally not stored in liquid state, thus liquid handling characteristics do not become relevant to the present means of operation. At this point, the gas in the central cavity 64 is now available for direct use by the airgun. Inasmuch as the original connection is made to the upper end of the strut 11, the portion of the strut threaded into the airgun is the exit point from the multi function refill adaptor of the present invention.

To perform refilling the supply vessel portion connected to the upper sleeve portion from an external source of gas, the lower sleeve 30 is removed and replaced with sleeve 50, sometimes referred to as the female fill collar. In properly positioning, the orifice 51 is placed over the orifice 17 included in strut 10. At this time, the valve on the connected bulk storage vessel would be open. Incoming gas passing through orifice 51 and inlet 17 passes through to a sump portion 62 formed by outer wall 48 of check valve body 40 to the inside walls of strut 10, again the sump functions to allow any liquid portion to fall by means of gas the bulk of the gas from the storage vessel, passing through opening 42 exerting pressure against movable section 41 of the check valve, whereby gas flows into sections 64 out through opening 16 into sump 61, from there out through opening 21 to connected supply vessel.

Normally, connection to the supply vessel is achieved through high pressure lines that connect the multi function refill adaptor to the now empty or depleted principal supply vessel. In this manner, the supply vessel is refilled. At such time as the gauge on the bulk supply source regulator indicates that the pressure has reached the preset value, connections from the bulk supply vessel at orifice 51 are removed. At this point, the internal pressure of gas will cause the movable portion 41 of the check valve to reseat itself, sealing external supply vessel 64 as well as providing connection to the associated airgun.

At this time, lower sleeve 50 or female refill collar, is removed and the standard lower sleeve 30 is replaced over strut 10, concluding the refill operation.

While but a single embodiment of the present invention has been shown, it will be obvious to those skilled in the art that numerous modifications may be made without departing from the spirit of the present invention which shall be limited only by the scope of the claims appended hereto.

What is claimed is:

1. A multi function adaptor for use with a gas operated airgun facilitating use of a compressed gas propellant and the refilling of a gas supply vessel connected to said airgun from an external bulk gas supply source, said adaptor comprising:

a strut comprising a hollow cylinder including external and internal walls;

a threaded section at one end of said strut adapted to be connected to said airgun;

a first sleeve comprising a hollow cylinder positioned over an upper section of said strut;

a first sump;

said first sleeve including a first orifice connected to said first sump, said orifice adapted to be connected to said gas supply vessel;

a second sump;

a second orifice connecting said first sump to said second sump;

a reverse check valve internal to said strut;

a third sump;

a third orifice connecting said third sump to said strut external walls;

a second sleeve positioned over the lower portion of said strut, sealing said third orifice facilitating the flow of gas from said gas supply vessel through said adaptor to said airgun;

and as a replacement for said second sleeve, a third sleeve, positioned over the lower portion of said strut;

said third sleeve including an orifice in connection with said strut third orifice extending to said third sump;

facilitating the flow of gas from an external bulk supply source through said adaptor to said gas supply vessel.

2. A multi function adaptor as claimed in claim 1 wherein:

said strut includes a first area of reduced diameter.

3. A multi function adaptor as claimed in claim 2 wherein:

said first sump is formed by said first sleeve in combination with said strut area of reduced diameter.

4. A multi function adaptor as claimed in claim 1 wherein:

said strut further includes a plurality of second areas of reduced diameter.

5. A multi function adaptor as claimed in claim 4 wherein:

said plurality of second areas of reduced diameter are each equipped with an "O" ring providing a gas tight seal between said strut and said first sleeve.

6. A multi function adaptor as claimed in claim 1 wherein:

said strut further includes a plurality of third reduced areas.

7. A multi function adaptor as claimed in claim 6 wherein:

said plurality of third areas of reduced diameter are each equipped with an "O" ring providing a gas tight seal between said second sleeve and said strut, or in the alternative providing a gas tight seal between said third sleeve and said strut.

8. A multi function adaptor as claimed in claim 1 wherein:

said reverse check valve further includes a first area of reduced diameter.

9. A multi function adaptor as claimed in claim 8 wherein:

said third sump is formed by said check valve first area of reduced diameter in combination with said strut internal wall.

10. A multi function adaptor as claimed in claim 1 wherein:

said check valve further includes a plurality of second areas of reduced diameter.

11. A multi function adaptor as claimed in claim 10 wherein:

said plurality of check valve second areas of reduced diameter are each equipped with an "O" ring providing a gas tight seal between said check valve and said strut internal wall.

12. A multi function adaptor as claimed in claim 1 wherein:

said second sump is formed within said strut internal walls above said check valve.

13. A multi function adaptor as claimed in claim 1 wherein:

said check valve includes a movable section operated to seal said second sump from said third sump.

14. A multi function adaptor as claimed in claim 13 wherein:

said reverse check valve movable section is displaced in response to a flow of gas from an external gas bulk supply source into said third sump facilitating the flow of gas from said third sump to said second sump.

* * * * *